United States Patent [19]

Baldi

[11] 3,936,539

[45] Feb. 3, 1976

[54] HIGH TEMPERATURE RESISTANT DIFFUSION COATING

[75] Inventor: Alfonso L. Baldi, Drexel Hill, Pa.

[73] Assignee: Alloy Surfaces Company, Inc., Wilmington, Del.

[22] Filed: Nov. 6, 1972

[21] Appl. No.: 304,220

Related U.S. Application Data

[63] Continuation-in-part of Ser. No. 254,403, May 18, 1972, Pat. No. 3,785,854, which is a continuation-in-part of Ser. No. 90,682, Nov. 18, 1970, Pat. No. 3,764,371.

[52] U.S. Cl. ..... 427/253; 118/48; 148/6

[51] Int. Cl. ..... C23c 13/02

[58] Field of Search ..... 117/107.2 P; 118/48; 29/194

[56] References Cited

UNITED STATES PATENTS

| | | | |
|---|---|---|---|
| 1,902,503 | 3/1933 | Howe | 117/107.2 P |
| 3,096,160 | 7/1963 | Puyear | 117/107.2 P |
| 3,286,684 | 11/1966 | Aves | 117/107.2 P |

FOREIGN PATENTS OR APPLICATIONS

| | | | |
|---|---|---|---|
| 1,182,407 | 2/1970 | United Kingdom | 117/107.2 R |

*Primary Examiner*—William E. Schulz
*Attorney, Agent, or Firm*—Connolly and Hutz

[57] ABSTRACT

Dispersion-strengthened nickel and nichrome protected by an aluminum diffusion coating over a chromium diffusion coating, have their resistance to oxidation at extremely high temperatures increased by including cobalt with the chromium diffusion coating. Aluminum diffusion can be effected with an energizer kept out of contact with workpieces by being confined in porous containers.

8 Claims, No Drawings

HIGH TEMPERATURE RESISTANT DIFFUSION COATING

This application is in part a continuation of application Ser. No. 254,403 filed May 18, 1972 (U.S. Patent 3,785,854 granted January 15, 1974), which in turn is in part a continuation of application Ser. No. 90,682 filed Nov. 18, 1970 (U.S. Patent 3,764,371 granted October 9, 1973).

The present invention relates to the coating of dispersion strengthened nickel and dispersion strengthened nichrome to increase their resistance to high temperatures, inside jet engines for example.

The foregoing as well as additional objects of the present invention will be more fully understood from the following description of several of its exemplifications.

Dispersion-strengthened nickel, now called DS nickel and previously called TD nickel, is manufactured with 2% or so of inert finely divided oxide such as $ThO_2$, $ZrO_2$, $HfO_2$ or $Eu_2O_3$, dispersed through the metal, and has unusually high strength at temperatures of about 2200° to 2300°F. To prevent it from rapidly oxidizing away when exposed to oxidizing atmospheres at those temperatures, it has been suggested to diffusion coat the metal with chromium and then with aluminum.

According to the present invention the oxidation resistance of those dual coatings is improved by incorporating a little cobalt in the aluminum layer. Such cobalt forms a cobalt-aluminum intermetallic that imparts to the aluminum coating the typical beige tinge of that intermetallic and also significantly increases the oxidation resistance. Only about 0.5% cobalt in the outer skin of the aluminum coating is sufficient to increase the high-temperature life of the double coating by at least about 20%.

Because cobalt and aluminum do not deposit together in a single diffusion coating step, the cobalt is combined with the chromium applied as the undercoat. As little as 1 to 2% cobalt content, preferably 4 to 8%, in the skin of the chromium diffusion case will be sufficient cobalt to provide the improved results of the present invention. During the application of the aluminum diffusion coating over the cobalt-containing chromium, the cobalt diffuses outwardly to form the desired cobalt aluminide.

For the greatest resistance the chromium case should show a pick-up of about 40 to 60 milligrams of chromium per square centimeter, and the aluminum pick-up should be about 1.5 to 4 milligrams per square centimeter. Such combinations provide a useful coating life of several hundred hours to 2200°F. At lower temperatures, as for example 2150°F or below, more than adequate coating life is obtained with the same pick-up of aluminum, but with a chromium pick-up of only 18–25 milligrams per square centimeter.

The heavier chromium pick-ups can be provided by the one-step chromizing described in the above-mentioned prior applications, or by using a succession of lower pick-up diffusion coating stages. The cobalt addition of the present invention can be confined to the last chromium coating although it can also be applied with each chromium layer if desired.

At the very high combustion temperatures to which a jet engine burner wall is subjected, a simple DS nickel wall about 1/16 inch thick should have the coating combination with the high chromium pick-up. However a so-called "finwall" hollow wall construction of thin sheet DS nickel with internal air cooling operates at lower temperatures and only needs the lower chromium pick-up coating combination. Heavier coatings on such thin sheet metal unduly increase its thickness.

A typical sequence of the present invention is:

EXAMPLE I

A jet engine burner housing of DS nickel 30 inches long and about 15 inches in maximum diameter was packed in an Inconel diffusion coating retort 40 inches high, using a pack made of, by weight,

| | |
|---|---|
| 20% | chromium |
| 3% | nickel |
| 3% | cobalt |
| 0.5% | $NH_4Cl$ |
| balance | $Al_2O_3$ |

all in powder form and intimately mixed together. The pack filled the retort to within 3 inches of its top, covered all of the outside surface of the housing, and completely filled its interior.

A loosely fitted cover was placed over the top of the retort after which the retort was placed on a furnace support and an outer retort bell lowered around it, as in the arrangement illustrated in the prior applications, and sealed against the support. A furnace shell was then lowered around the outer retort and a stream of argon was started through the interior of the outer retort to flush the air out, the argon then replaced by dry hydrogen, and the furnace turned on to bring the temperature in the interior of the retort to 2200°F. After 30 hours at that temperature, the furnace heat is turned off, the hydrogen continued till the temperature in the retort reaches 300°F, at which time it is replaced by argon to flush out the hydrogen, and the furnace shell removed. After unloading the burner housing and giving it a light blast cleaning with 100 grit aluminum oxide propelled by a blast of air from a 20 psig line, the coating case measures from about 45 to 55 milligrams per square inch throughout the treated surface, and an electron probe trace shows about 1.5% cobalt on the coated surface.

The housing is now packed again in the same inner retort cup, this time using the following chromium-inhibited aluminizing pack, as taken from Canadian Patent No. 806,618:

| | |
|---|---|
| Ultra-fine magnesothermic chromium powder | 40% |
| Very fine aluminum powder | 10% |
| Calcined alumina (minus 325 mesh) | 49.2% |
| Ammonium chloride | 0.8% |

The percentages are all by weight and the pack had been subjected to a preparatory break-in treatment at 1650°F. for five hours with no work-piece present, after which 0.8% $NH_4Cl$ was again added to it. The burner housing was also treated in the resulting pack at 1650°F. for 5 hours.

The final coated product after another light blasting with the same 100 grit aluminum oxide, has a smooth light-colored surface with a beige tinge and a weight gain from aluminum pick-up about 3 milligrams per square centimeter. A sample of its metal has a life in air at 2100°F. of about 600 hours before showing a loss of weight, whereas the same chromium and aluminum pick-ups without the use of the cobalt gives a coated DS nickel product that has a life of only about 250 hours in air at 2100°F. before showing a loss of weight.

A similar improvement in high temperature oxidation resistance is obtained when the aluminizing of the foregoing example is replaced by an aluminizing in an aluminizing pack of, by weight:

| | |
|---|---|
| Aluminum (minus 325 mesh) | 30% |
| Alumina (minus 325 mesh) | 70% |

to which is added aluminum chloride (anhydrous) in an amount ½% of the combined Al and $Al_2O_3$. The same heating procedure is used as for the chromizing, but the aluminizing pack is kept at 950°F. for 10 hours.

The foregoing burner housing has a wall of solid, that is not hollow, DS nickel approximately 70 mils thick, the dispersion strengthening ingredient being thorium oxide. When coating a similar burner housing made of "finwall" construction having an inside surface sheet 9 mils thick, an outside surface sheet 9 mils thick and an air space of about 60 mils between them with corrugated spacing strips of 9 mil DS nickel sheet spanning the air space every few millimeters, the coating procedure can be identical with that of Example I except that the chromizing time at temperature is reduced to 20 hours and the temperature to 2025°F. The chromium pick-up is then about 25 milligrams per square centimeter. While this coated finwall material shows a somewhat shorter life when tested in air at 2100°F., its life in an engine is actually as long or longer than that of a solid DS nickel wall. With the finwall construction the presence of the cobalt also adds at least about 20% to the life.

In the coating of the finwall construction, the diffusion coating pack is packed into the air space of the hollow walls, as well as inside and outside the entire burner housing. The packing in the air space is simplified by mounting the burner housing on a vibrator and vibrating the vibrator while the packed powder is poured into the accessible portions of the air space. Removal of the powder pack from the air space after the coating heat is completed, is more troublesome inasmuch as the powder is generally not fluent then and requires physical loosening. While such loosening can be effected by poking narrow probes into the air space, the powder removal can be greatly expedited through the use of a modified pack containing MgO as some or all of the inert filler. MgO is readily soluble in aqueous nitric acid containing as little as 5% acid and as much as 40%, by weight, while the chromized surface with and without the subsequent aluminizing is not attacked by such acid. It is accordingly a relatively simple matter, when removing the powder pack after a heat, to clean out any stubbornly held portions of the pack by pouring some 5% nitric acid over those portions and then waiting a few moments for the acid to react. A flush with water will then flush out the loosened pack remnants and also rinse away residual acid as well as acid reaction products. The acid will not attack the nickel or cobalt portions of the pack inasmuch as the nickel and cobalt become diffused with chromium in sufficient concentration to protect them. It will also not attack free aluminum in the pack. Chromium-inhibited aluminum in a pack will have the aluminum diffused into the chromium and the resulting alloy is also immune to the nitric acid treatment.

Only about 10% MgO in a pack will enable the foregoing simplified removal. It is preferred however when MgO is to be used that it constitute the entire inert filler.

The coating of the present invention is also suitable for protecting objects much smaller than the burner housing described above. However where smaller objects are to be chromized with the 40 to 60 milligram per square centimeter pick-up, the chromizing is best carried out in an unsealed cup-shaped retort at least 15 inches high, as described in application Serial No. 90,682. It is possible to obtain such high pick-ups with a vacuum-type diffusion as described in U.S. Pat. No. 3,290,126, and even in such vacuum chromizing the addition to the pack of cobalt in an amount 1/3 to 1/20 that of the chromium by weight, will provide the increased oxidation resistance of the present invention.

Nickel need not be used in a vacuum-type chromizing since it does not significantly affect such chromizing operation or the resultant product. On the other hand, in chromizing conducted at atmospheric pressure, the addition of the nickel is particularly desirable because it reduces the oxide content of the coating and thus renders the chromized case much more adherent. This is particularly significant with the heavier 40–60 milligrams per square centimeter coating pick-ups, although it still provides significant improvement with lower pick-ups down to even 15 milligrams of chromium per share centimeter. It appears that the vacuum of the vacuum-type chromizing is effective by itself to keep the oxide content of the coating sufficiently low, although a special atmosphere as described in Example I will not do this. The use of a halogen atmosphere, such as in a retort sealed by molten glass using iodine for example as an energizer to flush out the air and generate its own retort atmosphere, likewise does not keep down the oxide content of heavy chromized cases. Similarly the oxide content is not held down by an autogenous atmosphere provided when ammonium chloride or ammonium fluoride is used as an energizer with a retort sealed by molten glass. In both of these glass sealed retort arrangements the present invention can be practiced by using the packs described in Example I above or by the following alternative packs.

EXAMPLE II

| EXAMPLE II<br>Chromizing pack (by weight) |
|---|
| 25% chromium<br>2½% nickel<br>3½% cobalt<br>½% ammonium fluoride<br>balance MgO<br>coating temperature 2190°F.<br>coating time at temperature — 28 hours |
| Aluminizing pack (by weight) |
| 20% aluminum (plus 150 mesh)<br>½% ammonium chloride<br>balance alumina (plus 150 mesh)<br>coating temperature 1000°F<br>coating time at temperature — 5 hours |

The presence of cobalt in the chromizing packs of the present invention also reduces somewhat the coating temperature needed to provide the desired chromizing. Thus when using the chromizing pack of Example I, but without its cobalt, the chromium pick-up will not reach the desired levels in a 30-hour heat unless the coating temperature is maintained at 2250°F. or higher.

The presence of a small amount of magnesium halide powder (anhydrous) in the chromizing pack also seems to help a little in reducing the oxide content of the coating as described in application Ser. No. 90,682, but high quality results are obtained even when it is omitted.

For the lower ranges of chromium pick-up, it is not necessary to use a retort cup at least 15 inches high, and the following example illustrates such treatment.

EXAMPLE III

A DS nickel burner ring of finwall construction is chromized in a retort cup 5 inches high under an argon atmosphere using the following pack (by weight):

18% chromium
4% nickel
2½% cobalt
½% ammonium bromide
balance MgO
coating temperature 2050°F.
coating time at temperature — 30 hours The energizers used in any of the foregoing examples of atmospheric pressure coating can in general be a halogen or a halogenide that volatilizes as it is heated up to coating temperature to provide a halogen-containing atmosphere, as is recognized by the art. When the diffusion coating is applied under vacuum as in U.S. Pat. No. 3,290,126, a halogenide that does not volatilize is used and it is then preferred to have the pack contain a relatively large amount of diffusing metal, at least 40% by weight and as much as 80% by weight, if the coating time is to be kept down to reasonable lengths.

The pack, or at least those pack ingredients that remain solid during the coating, is of relatively fine particle size. The maximum particle size is desirably 150 microns and preferably less than 40 microns, although the activator particles can be up to about 1 millimeter in size without detracting from the quality of the coating. Best chromium-inhibited aluminizing results have been obtained with chromium particles less than 10 microns in size and with filler particles up to about 40 microns in size. Unless otherwise indicated particles that pass through a 50-mesh screen and do not pass through a 100-mesh screen are generally used.

The chromium diffusion packs also give better results for the second and subsequent coating treatments after they are freshly mixed. If desired the freshly mixed packs can be subjected to a blank run with or without work pieces before they are placed in service. Used packs are simply reused with the addition of another charge of activator, and scavenger if desired, so long as the metal content is adequate. About 1 to 2% chromium can also be added to used chromizing packs to keep the metal content substantially unchanged through successive coating runs. Cobalt consumption can be replaced by adding ¼ to ½% of fresh cobalt to the pack after each coating run. Any nickel additions should be kept very low inasmuch as there is very little nickel consumed during the coating.

The foregoing improvements are obtained on nickel that is dispersion strengthened with any of the oxides referred to above, and even with so-called DS nichrome which is a dispersion strengthened nickel-chromium alloy containing about 20% chromium. With DS nichrome, the chromium pick-up during chromizing can be less than 40 milligrams per square centimeter so that the chromizing time can be reduced when using the process of Example I, and 20 hours of chromizing will then provide a chromium pick-up of 30 milligrams per square centimeter. Alternatively DS nichrome will provide satisfactory results when the chromizing is carried out in a retort less than 10 inches high where only about a 20–25 milligram per square centimeter pick-up of chromium is obtained.

A preliminary break-in heat for the aluminizing pack is helpful but hydrated aluminum chloride can be used as the energizer for such packs, in which event break-in treatment can be dispensed with. Thus the substitution of 1.5% $AlCl_3 \cdot 6H_2O$ for the ammonium chloride or the anhydrous aluminum chloride energizers of the aluminizing treatments of Example I, gives about the same good results with or without such break-in, when the hydrated material is out of contact with the workpieces until the hydrated material vaporizes. This use of hydrated aluminum chloride without a break-in is also effective in aluminizing other metals including chromium-containing steels such as martensitic stainless steels, as well as low carbon steel. Aluminizing in this way is conducted in a hydrogen-blanketed or hydrogen-washed atmosphere as in Example I, although the blanketing or washing hydrogen can be diluted with as much as three times its volume of inert gases, such as argon. Hydrated aluminum bromide and hydrated aluminum iodide can be substituted for the hydrated aluminum chloride in equimolar amounts, but aluminum fluoride is not a suitable energizer for diffusion coatings and hydrated aluminum fluoride is likewise unsuitable.

As to the chromizing step of the process of the present invention when carried out without the use of evacuation, the chromium content of the chromizing pack can range from about 5 to about 50%, the nickel about ⅓ to about 1/20 of the chromium and the cobalt from 1/5 to ½% of the chromium, all values being by weight. The inert filler can be any such filler known, including kaolin, $Cr_2O_3$, and those mentioned above.

For the aluminizing step the aluminum content of the pack can range from 2 to 50% aluminum by weight with the remainder any of the inert fillers referred to above. The aluminizing temperatures can range from about 800° to about 1700°F. with a coating time at temperature about 4 to 20 hours. As pointed out above, the aluminizing can also be conducted with an inhibitor such as chromium also present in the pack. Such inhibited aluminizing is described in the above-mentioned Canadian Patent No. 806,618, as well as in U.S. Pat. No. 3,257,230, and is generally conducted at 1600°F. for about 5 hours, with ranges again from about 800° to 1700°F. from about 4 to about 10 hours. Where an ammonium compound is used as an energizer, best results are obtained when the coating temperature is sufficiently high to crack the ammonia that volatilizes from such compound, so that the upper portions of the above temperature ranges, above about 1000°F., are then preferred. On the other hand, aluminum halide energizers are preferred for use in the lower portions of those ranges at about 1000°F. or below.

Also all types of aluminum halide energizers are preferably kept out of contact with the workpieces until these energizers vaporize. Thus these energizers can be confined in porous containers, distributed throughout the pack and preferably so arranged as not to contact the workpieces. Alternatively these energizers can be mixed with a stratum of the pack below and out of contact with the workpieces, and/or above and out of contact with the workpieces and/or on the sides and out of contact with the workpieces. With virgin packs using a hydrated energizer, merely placing 3 to 6 grams of the energizer for 6.5 lb packs and larger quantities for larger packs on a section of fine stainless steel screen and then crumpling the screen around the so-placed portion of the energizer to encapsulate it, makes a suitable container of energizer that gives excellent coating results when such containers are two or more inches apart throughout the pack. The containers can be made of aluminum or of materials that do not appreciably diffuse into the workpieces during the aluminizing.

Other ingredients such as metallic manganese can also be present in the uninhibited aluminizing pack without affecting its operation parameters. The amount of manganese so included can range from about ¼ to ¾ the weight of the aluminum.

Obviously many modifications and variations of the present invention are possible in the light of the above teachings. It is therefore to be understood that within the scope of the appended claims the invention may be practiced otherwise than as specifically described.

What is claimed is:

1. The process of pack aluminizing method workpieces at temperatures of about 1000°F or below using an aluminum halide energizer selected from the group consisting of aluminum chloride, aluminum bromide, aluminum iodide or hydrated derivatives thereof, wherein the energizer is held in at least one porous container placed in the pack.

2. The combination of claim 1 in which the container is out of contact with the workpieces.

3. The combination of claim 1 in which the energizer is aluminum chloride.

4. The combination of claim 1 in which the container is made of a metal that does not appreciably diffuse into the workpieces during the aluminizing.

5. The combination of claim 1 in which the container is made of aluminum or stainless steel.

6. The combination of claim 2 in which the energizer is aluminum chloride.

7. The combination of claim 1 in which the workpieces are chromium-containing steel.

8. The combination of claim 6 in which the workpieces are chromium-containing steel and the container is made of aluminum or stainless steel.

* * * * *

UNITED STATES PATENT OFFICE

CERTIFICATE OF CORRECTION

Patent No. 3,936,539 Dated February 3, 1976

Inventor(s) Alfonso L. Baldi

It is certified that error appears in the above-identified patent and that said Letters Patent are hereby corrected as shown below:

Column 1, line 22, "through" should read -- throughout --.

Column 1, line 49, after "greatest" insert -- oxidation --.

Column 1, line 54, "to" should read -- at --.

Column 2, line 7, after "typical" insert -- coating --.

Column 8, line 2, "method" should read -- metal --.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*